US012116167B2

(12) United States Patent
Labonski

(10) Patent No.: US 12,116,167 B2
(45) Date of Patent: Oct. 15, 2024

(54) APPARATUS AND METHOD FOR DISTINGUISHING CONTAINERS

(71) Applicant: James Labonski, Philadelphia, PA (US)

(72) Inventor: James Labonski, Philadelphia, PA (US)

( * ) Notice: Subject to any disclaimer, the term of this patent is extended or adjusted under 35 U.S.C. 154(b) by 35 days.

(21) Appl. No.: 16/591,586

(22) Filed: Oct. 2, 2019

(65) Prior Publication Data

US 2020/0239189 A1 Jul. 30, 2020

Related U.S. Application Data

(63) Continuation-in-part of application No. 14/539,085, filed on Nov. 12, 2014, now abandoned.

(51) Int. Cl.

| | |
|---|---|
| ***B65D 23/14*** | (2006.01) |
| ***B65D 23/08*** | (2006.01) |
| ***B65D 25/20*** | (2006.01) |
| ***B65D 25/36*** | (2006.01) |

(52) U.S. Cl.

CPC ..... *B65D 23/14* (2013.01); *B65D 23/0842* (2013.01); *B65D 25/205* (2013.01); *B65D 25/36* (2013.01)

(58) Field of Classification Search

CPC .... B65D 23/14; B65D 23/0842; B65D 25/36; B65D 25/205; B65D 2203/02

See application file for complete search history.

(56) References Cited

U.S. PATENT DOCUMENTS

| | | | | | |
|---|---|---|---|---|---|
| 2,914,166 | A * | 11/1959 | Bihler | G09F 3/0295 | 206/820 |
| 4,884,827 | A * | 12/1989 | Kelley | G09F 3/0295 | 283/81 |
| 4,921,277 | A * | 5/1990 | McDonough | G09F 3/00 | 283/900 |
| 4,972,615 | A * | 11/1990 | Grant | G09F 3/10 | 40/641 |
| 5,881,597 | A * | 3/1999 | Brooks | G01F 19/00 | 73/428 |
| 5,958,536 | A * | 9/1999 | Gelsinger | G09F 3/0288 | 428/40.1 |
| 6,086,107 | A * | 7/2000 | Whistler | G09F 3/10 | 156/263 |
| 6,860,513 | B2 * | 3/2005 | Kaufman | B42D 15/00 | 156/212 |
| 7,455,662 | B2 * | 11/2008 | Kraushaar | A61M 5/14 | 604/80 |
| 9,524,659 | B2 * | 12/2016 | Barry | B65C 3/16 | |
| 11,278,904 | B2 * | 3/2022 | Carty | G09F 3/0288 | |
| 2002/0038392 | A1 * | 3/2002 | De La Huerga | G16H 20/17 | 710/8 |
| 2002/0162261 | A1 * | 11/2002 | West | G09F 7/00 | 40/595 |
| 2003/0066219 | A1 * | 4/2003 | Palumbo | G09F 23/10 | 40/641 |

(Continued)

*Primary Examiner* — Cassandra Davis

(74) *Attorney, Agent, or Firm* — Gearhart Law, LLC

(57) ABSTRACT

A system for marking a container includes a wrap comprising an adhesive backend. The wrap is configured to wrap around a container. The system also includes a tab configured to adhere to the container and protrude away from the container. The wrap and the tab comprise indicia for identifying the container or the contents of the container.

13 Claims, 22 Drawing Sheets

(56) References Cited

U.S. PATENT DOCUMENTS

| | | | | |
|---|---|---|---|---|
| 2005/0258636 | A1* | 11/2005 | Bova | G09F 3/10 283/81 |
| 2005/0268505 | A1* | 12/2005 | Sandel | G09F 3/00 604/189 |
| 2008/0188814 | A1* | 8/2008 | Lavi-Loebl | G09F 3/10 604/189 |
| 2008/0276504 | A1* | 11/2008 | Cloninger | G09F 3/0288 40/312 |
| 2010/0325928 | A1* | 12/2010 | Moulton | G09F 3/0288 40/299.01 |
| 2011/0195217 | A1* | 8/2011 | Sato | B42D 5/003 156/182 |
| 2012/0305177 | A1* | 12/2012 | Simmons | G09F 3/10 156/247 |
| 2013/0170938 | A1* | 7/2013 | Lowden | B42F 21/06 294/212 |
| 2014/0034227 | A1* | 2/2014 | Segui | G09F 3/10 428/41.8 |
| 2016/0267818 | A1* | 9/2016 | Lindberg | G09F 3/02 |

* cited by examiner

APPARATUS AND METHOD FOR DISTINGUISHING CONTAINERS

CROSS-REFERENCE TO RELATED APPLICATIONS

This application is a continuation-in-part application of U.S. patent application Ser. No. 14/539,085, titled "Apparatus and Method for Distinguishing Containers" and filed on Nov. 12, 2014, which is expressly incorporated by reference herein in its entirety.

FIELD OF INVENTION

The present disclosure relates to apparatus and methods for distinguishing items such as containers among a plurality of items. More specifically, the present disclosure relates to application of indicative apparatus to items such as containers to distinguish the item among a plurality of containers.

BACKGROUND

It is common for products sold and distributed to consumers to include a number of variations and varieties. For example, prescription medications are sold to address a variety of illnesses and ailments, many food products are sold in a variety of flavors, and motor oil is sold in a variety of grades. However, such product variations are often packaged in a manner that make it difficult for consumers to distinguish between the product variations. For example, product variations can be packaged in similar containers with the only differences being minor modifications to the language printed on labels. Such an inability to readily distinguish between products can be particularly problematic when the products are prescription medications. If a consumer does not ingest prescription medications in accordance with a physician's instructions, the consumer can be exposed to health related risks. For example, a consumer can be at risk for overdosing on a particular medication, not ingesting enough of a particular medication to effectively treat a medical condition, or combining medications that cause severe side effects upon combination.

Factors such as the aging of the general population, the continuous development and marketing of new medications, and the general increase in the number of medications prescribed by physicians necessitate consumers having to manage an ever growing number of prescription medications on a daily basis. The already difficult task of managing a large number of prescription medications is exacerbated by the manner in which the pharmaceutical industry packages and distributes prescription medication. Such medication is typically distributed by a local or mail-order pharmacy, and the medications are distributed in similar if not identical containers. Typically, the only distinguishing feature of the medications is a technical name for the medication printed in small print on a generic label. Reading the small print in order to identify and distinguish medications may be difficult, particularly for the elderly and for people with low vision. Moreover, because of health care plan limitations or cost considerations, generic medications are commonly used. Generic medication typically displays the technical name for the medication, which may be difficult to read, pronounce, and memorize, further exacerbating the difficult task of managing a large number of medications.

For example, a consumer may be prescribed a first medication to treat high blood pressure, a second medication to treat cholesterol, and a third medication to treat angina (i.e., chest pain). As illustrated in FIG. 1, the first medication can be packaged in a familiar small brown bottle 102 with a relatively small label 104 that includes the technical term "chlorthalidone" printed in small print on the label 104. The second medication can also be packaged in a similar or identical small brown bottle 106 with a similar or identical relatively small label 108 that includes the technical term "lovastatin" printed in small print on the label 106. The third medication may also be packaged in a similar or identical small brown bottle 110 with a similar or identical relatively small label 112 that includes the technical term "nitroglycerin" printed in small print on the label 112.

Physician's instructions can dictate that the high blood pressure medication should be taken daily, the cholesterol medication taken three times a week, and the angina medication taken only as needed, including when a person shows early signs of a heart attack. As illustrated in FIG. 1, it can be difficult to distinguish between the three bottles 102, 106, 110 when choosing the medication scheduled to be ingested. Such difficulty in distinguishing bottles can lead to the person, for example, undertaking the high blood pressure medication or overtaking the cholesterol medication. Even more importantly, the difficulty in distinguishing bottles can lead to a person that is experiencing early signs of a heart attack ingesting high blood pressure medication or cholesterol medication instead of the appropriate angina medication.

Therefore, there is a need for apparatus and methods that can assist in distinguishing items such as prescription medication bottles so that the contents or identity of the item are more readily ascertained by and known to an observer of the containers.

SUMMARY OF THE INVENTION

In one embodiment, a system for marking a container is disclosed. The system includes a wrap comprising an adhesive backend. The wrap is configured to wrap around a container. The system also includes a tab configured to adhere to the container and protrude away from the container. The wrap and the tab comprise indicia for identifying the container or the contents of the container.

In one embodiment, a container marking kit is disclosed. The container marking kit includes a wrap configured to wrap around and secure to a container. The container marking kit further includes a tab comprising an adhesive portion. The tab is configured to adhere to the container and protrude away from the container. The wrap and the tab comprise indicia for identifying the container or the contents of the container.

In one embodiment, a method of marking a container is disclosed. The method comprising the step of securing a wrap around a container. The method further comprises the step of securing a protruding tab to the container. The wrap and the tab comprise an indicium for identifying the container or the contents of the container.

BRIEF DESCRIPTION OF THE DRAWINGS

In the accompanying drawings, structures are illustrated that, together with the detailed description provided below, describe exemplary embodiments of the claimed invention. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

The apparatus, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be and should not be construed as mandatory or limiting unless specifically designated as such. Selected examples of apparatus, arrangements, and methods for distinguishing containers among a plurality of containers are hereinafter disclosed and described in detail with reference made to FIGS. 1-22.

The development of apparatus and methods for distinguishing containers among a plurality of containers can result in observers of the containers more readily ascertaining to contents of the containers. The application of various apparatus that include indicia, such as text, color, graphics, markings, symbols, and the like that are indicative of the contents of the container can facilitate an observer more readily ascertaining the contents of a container.

A number of examples and embodiments of pre-prepared and customizable apparatus with such indicia are described and disclosed herein. Although the examples and embodiments described herein are generally directed to prescription medication bottles, it will be understood by those skilled in the art that such examples and embodiments disclosed herein can be applied to any number of items. For example, such examples and embodiments can be applied to food containers to distinguish similar products for those that have medical, religious, or voluntary dietary restrictions. In another example, such examples and embodiments can be applied to vitamin and nutritional supplement bottles and packaging.

Figure 1:
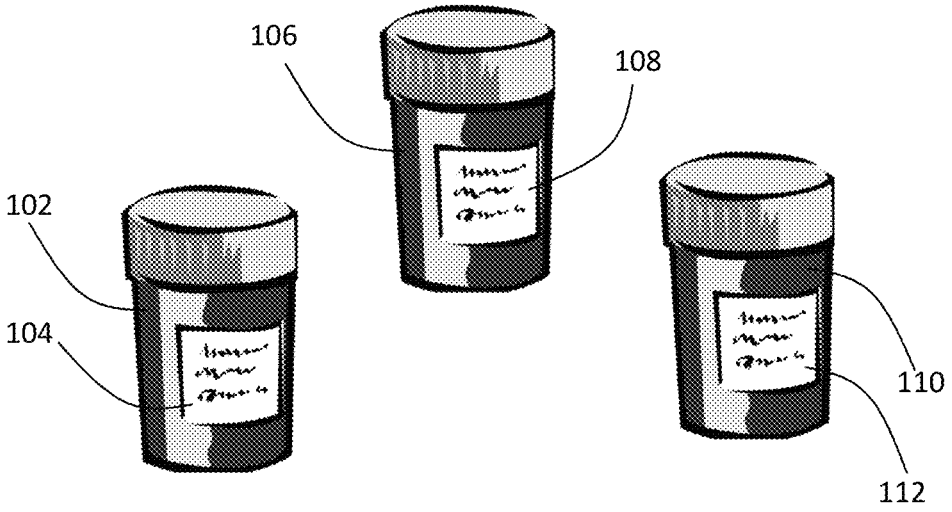
Prior Art FIG. 1
FIG. 1 is a perspective view of a plurality of prior art prescription medication bottles.
Figure 2:
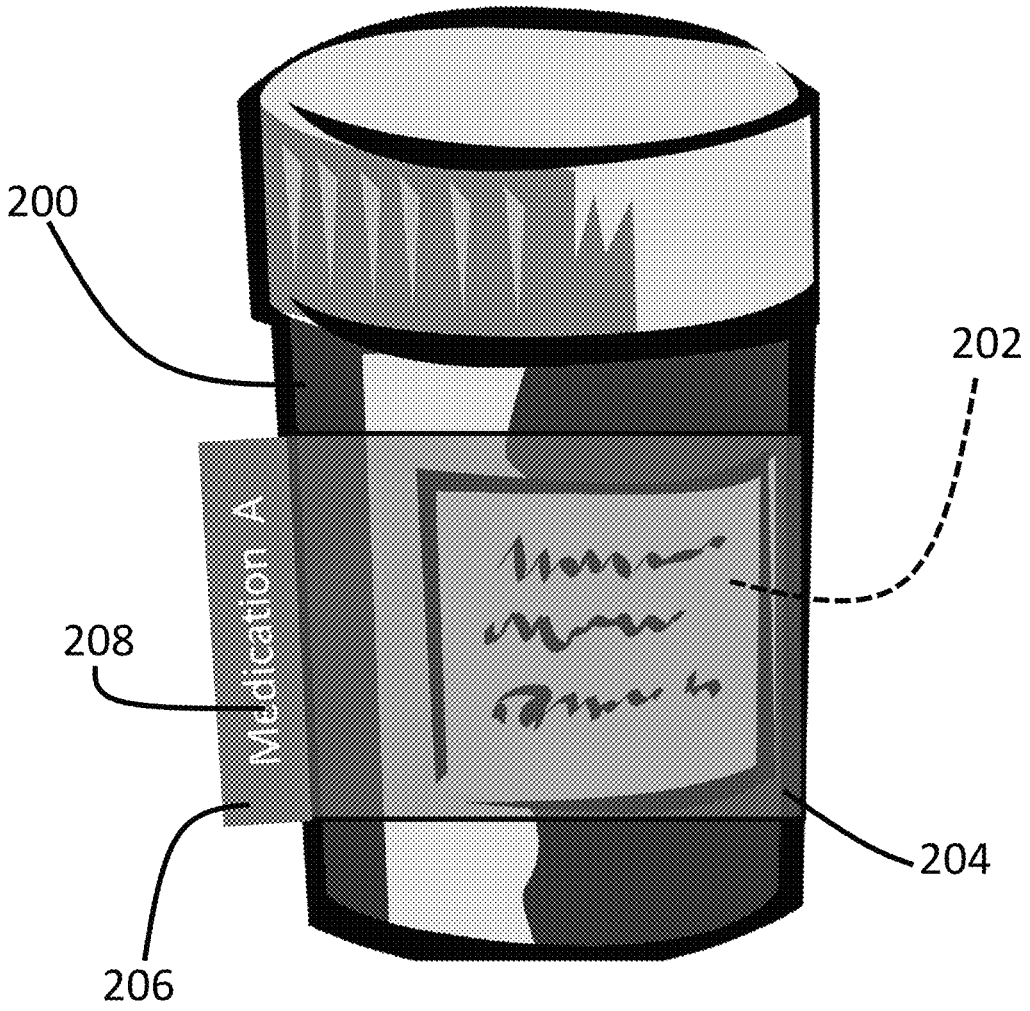
FIG. 2 is a perspective view of a prescription medication bottle with a wrap and a tab applied to said bottle in accordance with one embodiment.
Figure 3:
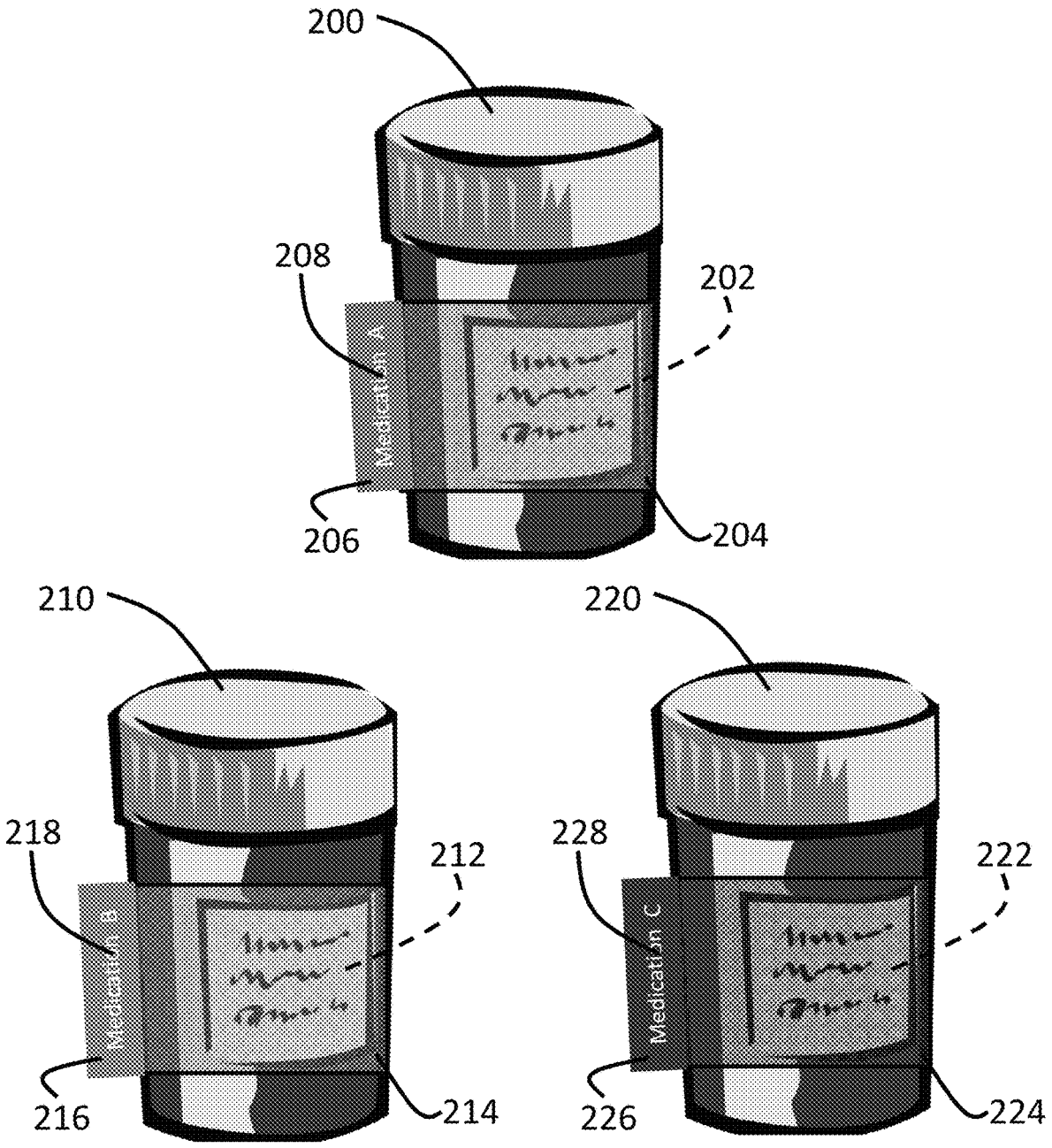
FIG. 3 is a perspective view of a plurality of prescription medication bottles with a wrap and a tab applied to each bottle in accordance with one embodiment.

In one exemplary embodiment, as illustrated in FIGS. 2 and 3, color and text are utilized to distinguish prescription medication bottles among a plurality of prescription medication bottles. FIG. 2 illustrates a prescription medication bottle 200 with a label 202. The label 202 can be the label that is typically adhered to the prescription medication bottle 200 by a pharmacist or similar pharmaceutical personnel at the time the prescription medication bottle 200 is filled with the prescribed medication. A wrap 204 can be secured to the prescription medication bottle 200. As illustrated in FIG. 2, the wrap 204 can be placed over the label 202 and can be substantially transparent so that any text or symbols on the label 202 remain viewable by any observer. The wrap 204 can be a distinctive color, such as blue, green, red, or any other distinctive color to distinguish the wrap 204, and thus distinguish the medication prescription bottle 200, from the features of other prescription medication bottles in the vicinity. The wrap 204 can be secured along the entire outer surface of the prescription medication bottle 200 or secured only along a portion of the outer surface of the prescription medication bottle 200. Furthermore, the wrap 204 can be secured along the entire height of the prescription medication bottle 200 or secured only along a portion of the height (as illustrated in FIG. 2) prescription medication bottle 200.

In addition, a tab or flag 206 can be secured to the prescription medication bottle 200. As illustrated in FIG. 2, the tab 206 can be secured such that it extents away from the prescription medication bottle 200 for easy viewing by an observer. The tab 206 can be a distinctive color, such as blue, green, red, or any other distinctive color to distinguish the tab 206, and thus the prescription medication bottle 200, from other prescription medication bottles in the vicinity. The color of the tab 206 can be arranged to match the color of the wrap 204 secured to the prescription medication bottle 200. The color of the tab 206 can also be arranged to be a different color than the wrap 204 to complement or contrast with the color of the wrap 204. Text 208 can be applied to the tab 206 to further distinguish the prescription medication bottle 200 from others in the vicinity. The text 208 as shown in FIG. 2 reads "Medication A." However, it will be understood that the text 208 of FIG. 2 is merely representative of a large variety of possible names or descriptions of medications. As will be subsequently described, the text 208 can be preprinted on the tab 206 or can be customized by the consumer with a writing utensil or sticker. The text 208 can be printed or otherwise applied in a variety of colors to further distinguish the text 208.

With reference to FIG. 3, it will be understood that the presence and color of a wrap, the presence and color of a tab, and the presence and color of text on a tab can each or in combination facilitate an observer distinguishing one prescription medication bottle from a plurality of prescription medication bottles. FIG. 3 illustrates the prescription medication bottle 200 of FIG. 2 (to be referred herein as the "first prescription medication bottle") along with a second prescription medication bottle 210 and third prescription medication bottle 220. The second prescription medication bottle 210 includes a pharmacy applied label 212, a wrap 214, a tab 216, and text 218 applied to the tab 216. The third prescription medication bottle 220 includes a pharmacy applied label 222, a wrap 224, a tab 226, and text 228 applied to the tab 226.

In one example, the first prescription medication bottle 200 can have a blue semi-transparent wrap 204, a solid blue tab 206, and text 208 indicative of the medication contained in the first prescription medication bottle 200. The second prescription medication bottle 210 can have a green semi-transparent wrap 214, a solid green tab 216, and text 218 indicative of the medication contained in the second prescription medication bottle 200. The third prescription medication bottle 220 can have a red semi-transparent wrap 224, a solid red tab 226, and text 228 indicative of the medication contained in the third prescription medication bottle 200. As will be understood, an observer viewing the three prescription medication bottles 200, 210, 220 can rely on a number of visual indications to distinguish each of the prescription medication bottles 200, 210, 220 from the group of prescription medication bottles 200, 210, 220. For example, the observer can rely on the color of the wrap 204, 214, 224; the color of the tab 206, 216, 226, the text 208, 218, 228; and combinations thereof to distinguish the prescription medication bottles 200, 210, 220. Further, the observer can still be provided with visual access to the label 202, 212, 222 so as to view or read any information displayed on the label 202, 212, 222. However, the observer does not have to rely on the labels 202, 212, 222 provided by the pharmacy to distinguish the prescription medication bottles 200, 210, 220.

As will be understood a consumer or patient can establish a color coded system to mark and identify prescription medications. For example, a blue wrap can identify a prescription medication bottle that contains high blood pressure medication; a green wrap can identify a prescription medication bottle that contains cholesterol medication, and a red wrap can identify a prescription medication bottle that contains angina medication. Thus, a consumer or patient can differentiate and identify the prescription medication bottles 200, 210, 220 by viewing the color of the wraps 204, 214, 224 and without having to read labels 202, 212, 222 provided by a pharmacy that can be difficult to read and/or confusing.

It will be appreciated that any number and color combinations of wraps can be used to differentiate and identify any number of prescription medication bottles. In one example, a wrap can be arranged to be clear or patterned such as striped, checkered, and the like. Furthermore, it will be appreciated that the colors of the wraps can be designated as having various suitable general meanings as well as meaning that concur with a person's particular preferences.

It will be appreciated that any number and color combinations of tabs can be used to differentiate and identify any number of prescription medication bottles. In one example, a tab can be arranged to be clear or patterned such as striped, checkered, and the like. When used in combination with a wrap, a tab can be arranged to be the same color as the wrap or arranged to be a different color than the wrap. Furthermore, it will be appreciated that the colors of the tabs can be designated as having various suitable general meanings as well as meaning that concur with a person's particular preferences.

Figure 4:
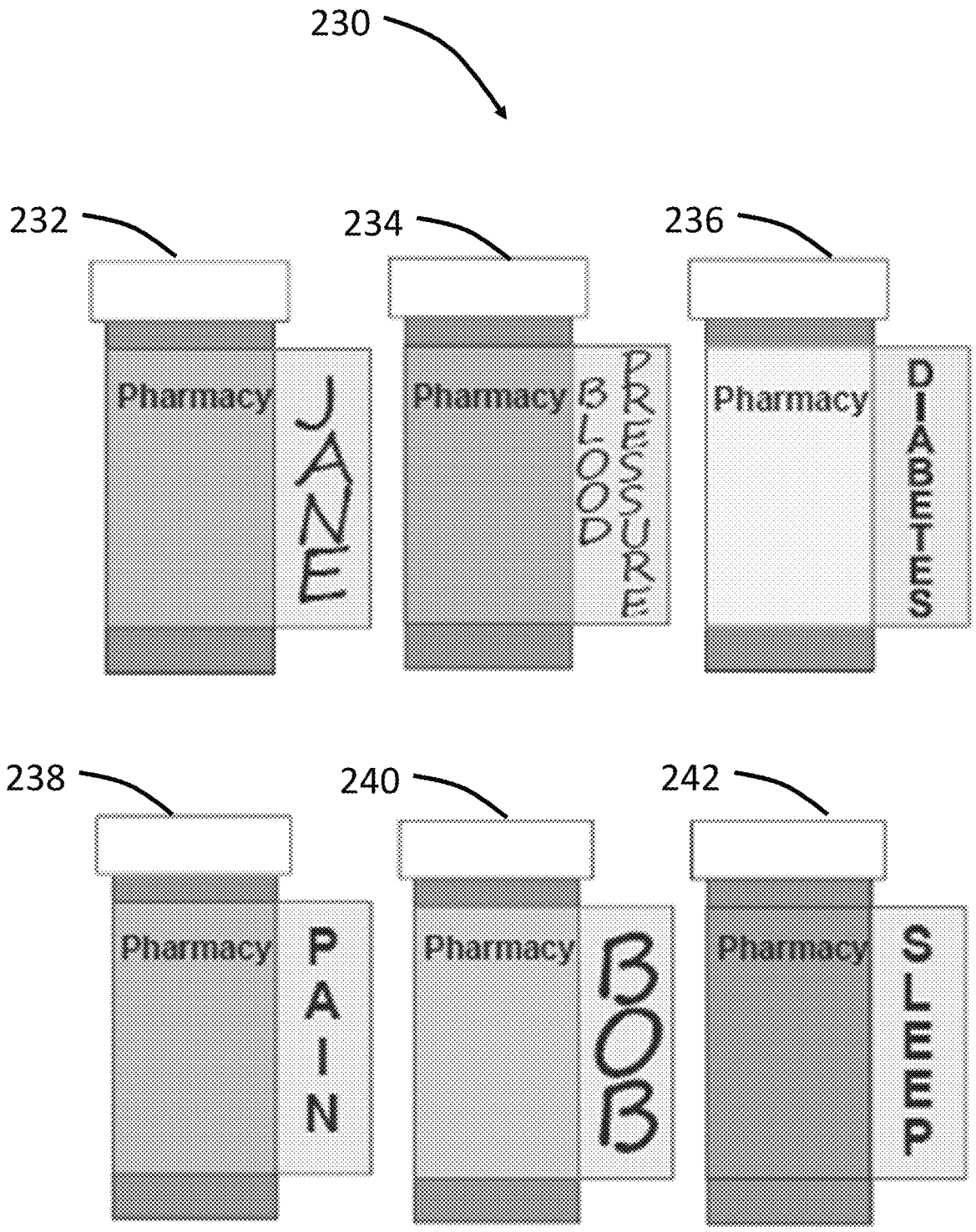
FIG. 4 is a perspective view of a group of prescription medication bottles with a wrap and a tab applied to each bottle in accordance with one embodiment for use by a couple that cohabitate.

FIG. 4 illustrates an exemplary group of prescription medication bottles 230 used, for example, by a married couple. Spouses and other family members often store prescription medication bottles in a common location such as a medicine cabinet in a kitchen or bathroom of a residential home. Distinguishing between medications intended for specific family members can be crucial to the health of the family members. In the example of FIG. 4, one spouse, named Jane, regularly takes medications to treat high blood pressure and diabetes. The other spouse, named Bob, takes medication to treat pain and a sleep disorder. In addition, both spouses take medication to control cholesterol. As shown in FIG. 4, the couple can mark the prescription medication bottles in a manner to distinguish the prescription medication bottles. For example, Jane's high blood pressure medication bottle 234 can be marked with the term "blood pressure" and Jane's diabetes medication bottle 236 can be marked with the term "diabetes." Since only Jane takes medication to treat high blood pressure and diabetes, both Bob and Jane understand that prescription medication bottles 234 and 236 are intended for Jane. In addition, Jane can distinguish between her high blood pressure medication bottle 234 and her diabetes medication bottle 236.

Similarly, Bob's pain medication bottle 238 can be marked with the term "pain" and Bob's sleep disorder medication bottle 242 can be marked with the term "sleep." Since only Bob takes medication to treat pain and a sleep disorder, both Jane and Bob understand that prescription medication bottles 238 and 242 are intended for Bob. In addition, Bob can distinguish between his pain medication bottle 238 and his sleep disorder medication bottle 242.

Because both Jane and Bob take medication to control cholesterol, Jane and Bob can choose to label their respective cholesterol medication bottles with their names. For example, Jane's cholesterol medication bottle 232 can be labeled with the term "Jane," and Bob's cholesterol medication bottle 240 can be labeled with the term "Bob." Thus, Jane and Bob can distinguish between the two cholesterol medication bottles 232, 240.

Figure 5:
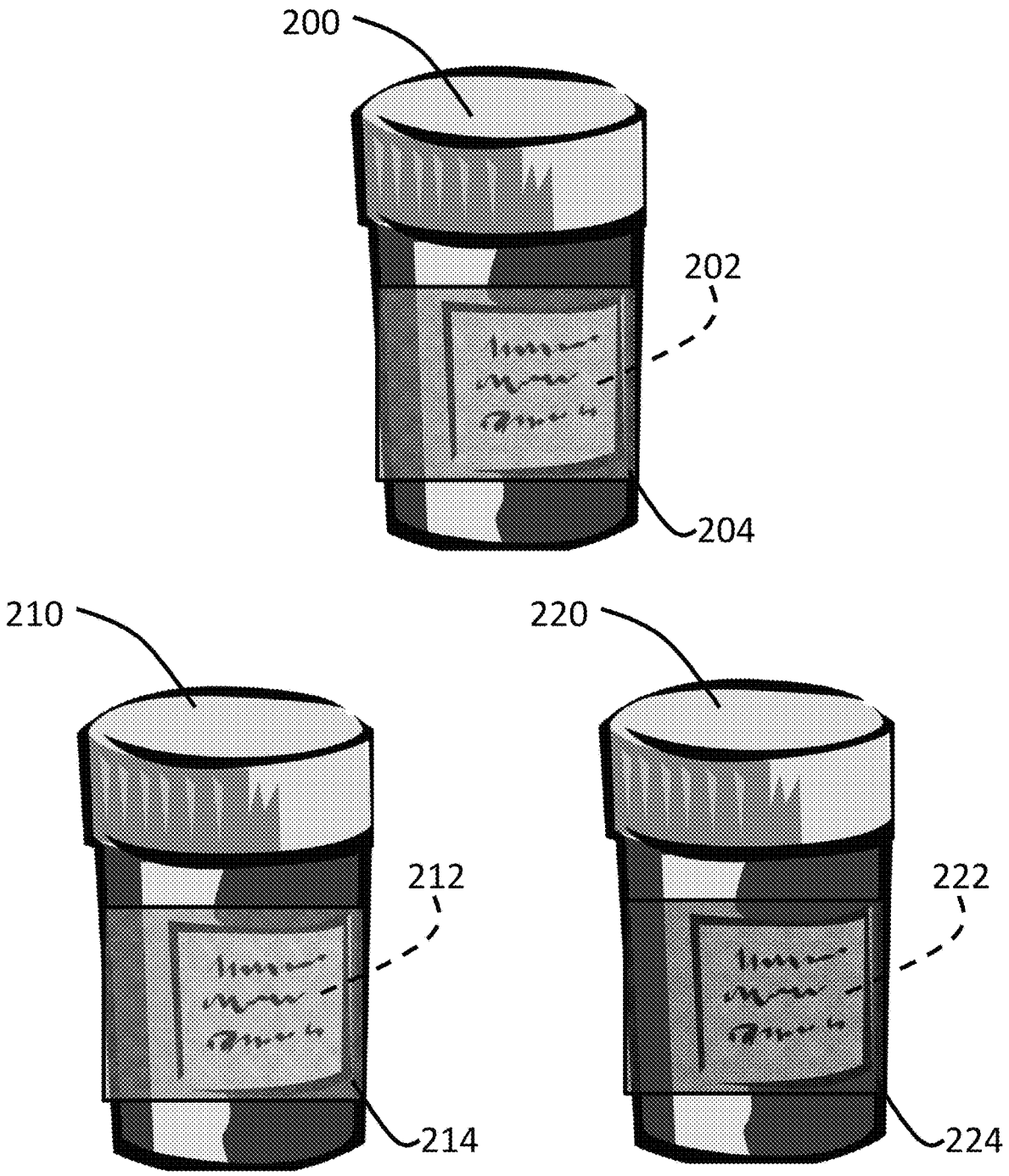
FIG. 5 is a perspective view of a plurality of prescription medication bottles with a wrap applied to each bottle in accordance with one embodiment.

In another embodiment, as illustrated in FIG. 5, the wrap 204, 214, 224 can be applied to prescription medication bottles 200, 210, 220 without the use of tabs or flags. As previously described, the prescription medication bottles 200, 210, 220 and wraps 204, 214, 224 can be arranged in accordance to the preferences of the consumer or patient such as applying a specific color wrap for a specific type of medication. Furthermore, text can be applied to the wraps 204, 214, 224 to further distinguish the prescription medication bottles 200, 210, 220.

Figure 6:
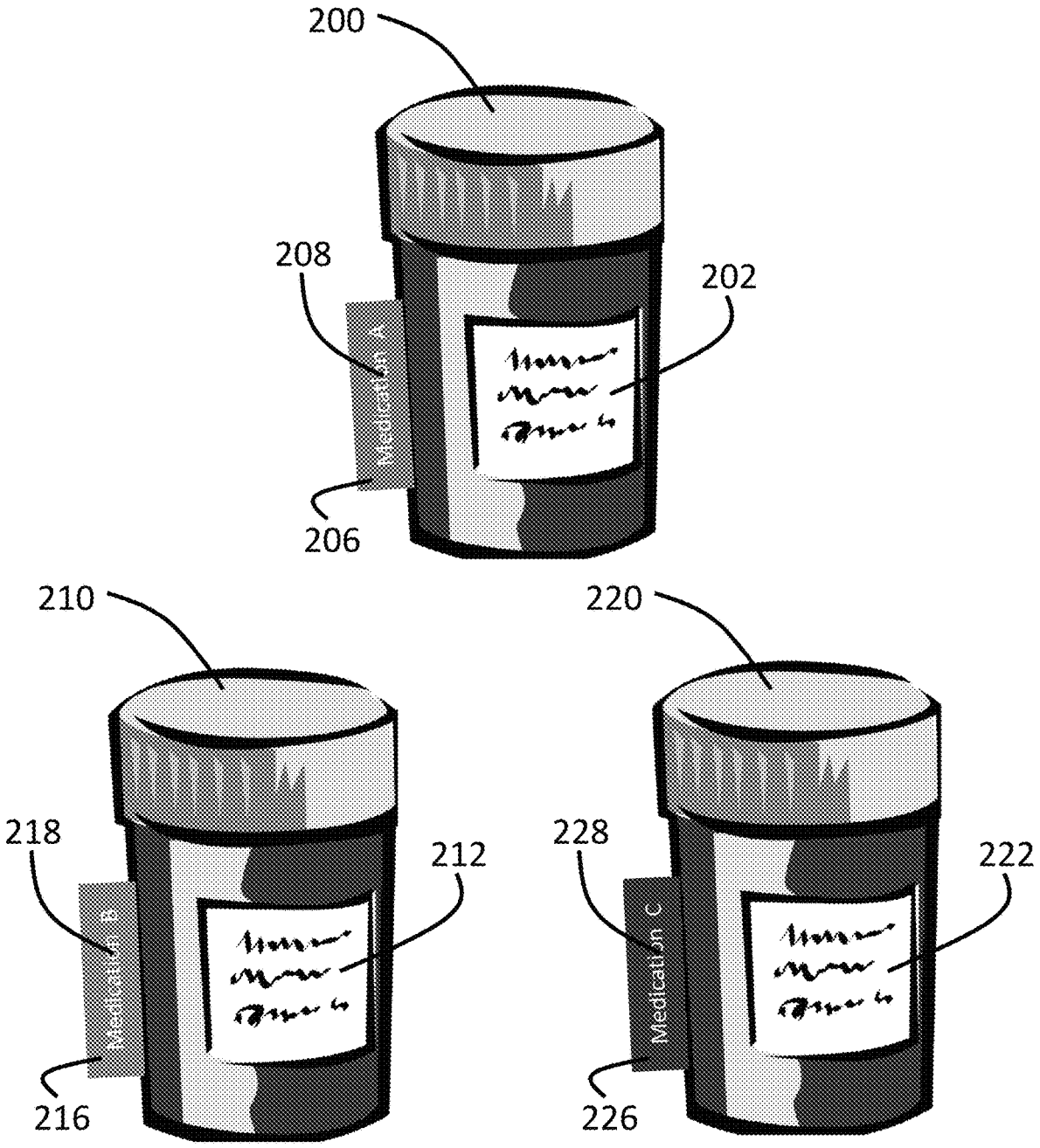
FIG. 6 is a perspective view of a plurality of prescription medication bottles with a tab applied to each bottle in accordance with one embodiment.

In another embodiment, as illustrated in FIG. 6, the tabs 206, 216, 226 can be applied to prescription medication bottles 200, 210, 220 without the use of wraps. As previously described, the prescription medication bottles 200, 210, 220 and tabs 206, 216, 226 can be arranged in accordance to the preferences of the consumer or patient such as applying a specific color tab for a specific type of medication. Furthermore, as previously described, text 208, 218, 228 can be applied to the tabs 206, 216, 226 to further distinguish the prescription medication bottles 200, 210, 220.

Figure 7:
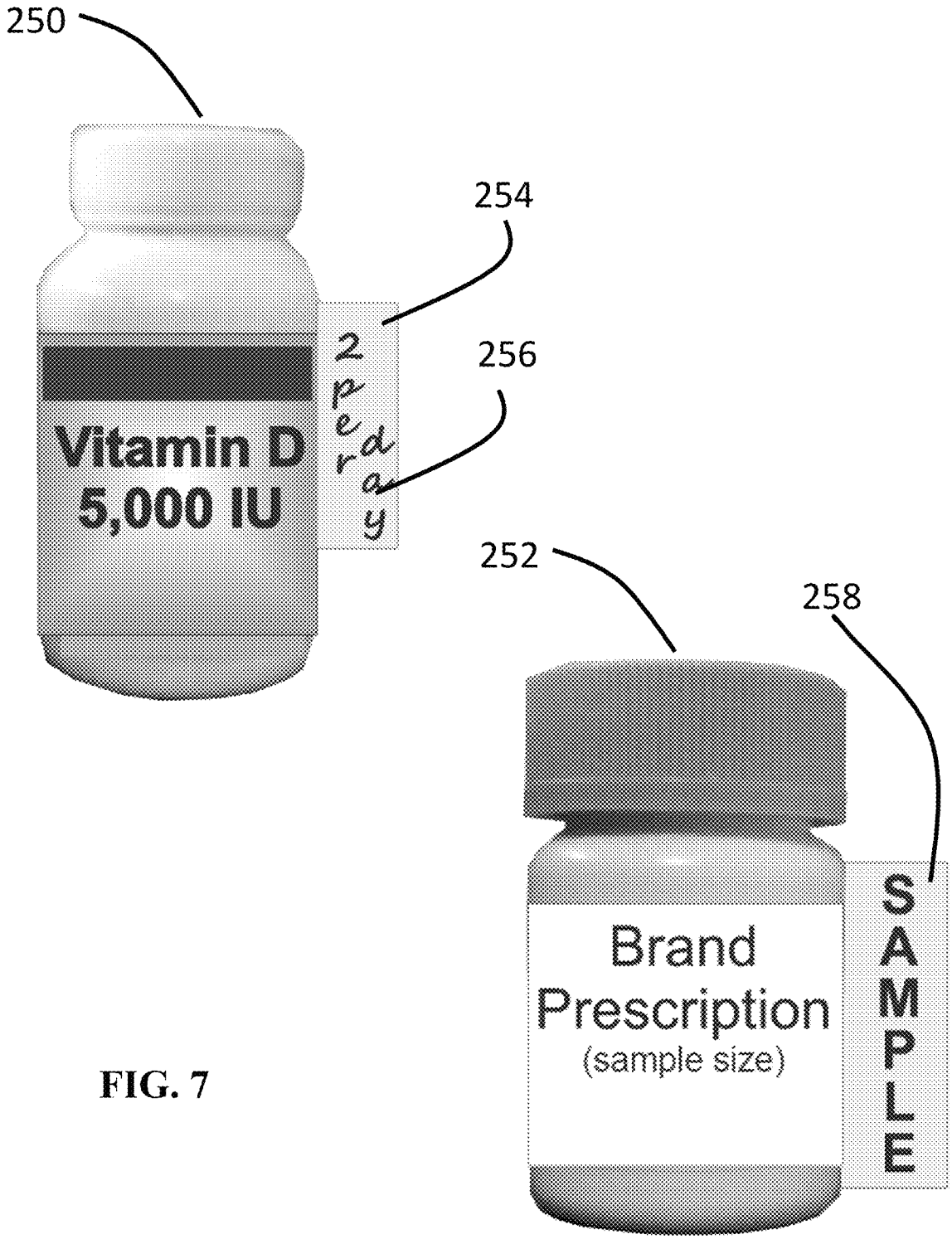
FIG. 7 is a perspective view of a two prescription medication bottles with a tab applied to each bottle in accordance with one embodiment.

FIG. 7 illustrates two examples of tabs applied to bottles 250, 252. A tab 254 can be attached to a vitamin bottle 250, and text 256 can be applied to the tab 254. The tab 254 can be applied in a manner where the original labeling of "Vitamin D 5,000 IU" remains visible, while adding information content such as the vitamin should be taken at a dosage of "2 per day." Prescription medication bottle 252 is illustrated with an example of a larger tab 258 applied to the prescription medication bottle 252. Such larger tabs can be used for consumers that benefit from large print such as elderly consumers or consumers with limited vision.

It will be understood that the arrangements and methods of labeling bottles illustrated in FIGS. 2-7 are exemplary and not exhaustive of all possibilities. Those skilled in the art will understand that numerous other arrangements and methods for labeling items such as containers are embodied in this disclosure. Furthermore, it will be understood that individual methods and arrangements of FIGS. 2-7 can be combined and/or substituted to achieve desirable embodiments.

Figure 8:
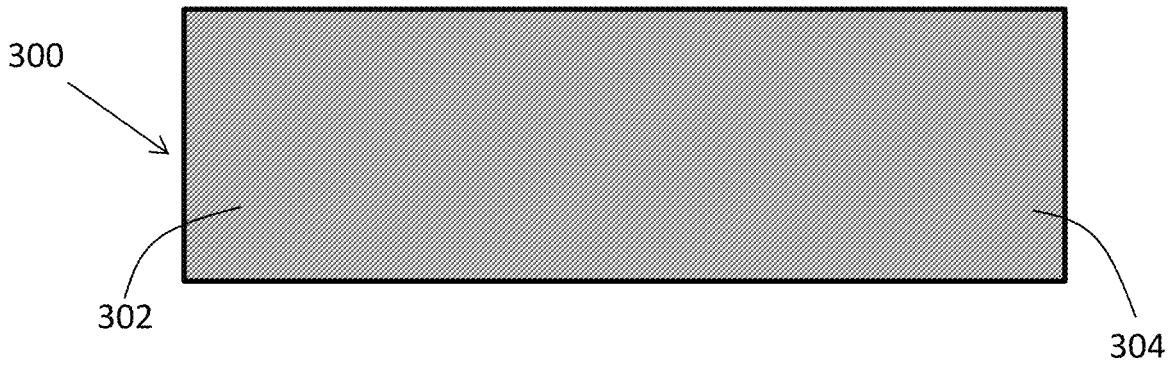
FIG. 8 is a plan view of a wrap in accordance with one embodiment.

FIG. 8 illustrates an exemplary wrap 300 for application to a container such as a prescription medication bottle. The wrap 300 can include an adhesive on a surface of the wrap 300 that is arranged to interface with the prescription medication bottle. The adhesive can facilitate the wrap 300 adhering to the prescription medication bottle. The wrap 300 can include any suitable adhesive such as glue, tape, and the like. The adhesive can be applied to the wrap 300 to sufficiently secure the wrap 300 to the prescription medication bottle. In one embodiment, adhesive is applied to the entire surface arranged to interface with the prescription medication bottle. In another embodiment, adhesive is applied to a portion of the surface arranged to interface with the prescription medication bottle. For example, adhesive can be applied to a first end 302 and a second end 304. In another example, adhesive can be applied along the perimeter of the surface of the wrap 300 arranged to interface with the prescription medication bottle. In yet another example, adhesive can be applied in a pattern to the surface of the wrap 300 arranged to interface with the prescription medication bottle.

The adhesive can be applied to the wrap 300 so that the wrap is reversibly secured to a container such as a prescription medication bottle. This is to say that the wrap 300 can be first applied to a prescription medication bottle and then at a later time removed from the prescription medication bottle such that the wrap 300 remains intact. In such an embodiment, the wrap 300 can be arranged to be reusable after the wrap 300 has been applied to and removed from a prescription medication bottle. In yet another example, the wrap 300 can be arranged such that the wrap 300 is secured to a prescription medication bottle by static forces.

As previously discussed, wrap 300 can be any suitable color. In one example, the wrap 300 can be clear. In another example, the wrap 300 is clear with a colored border. In another example, the wrap 300 is at least partially transparent or translucent. In one example, the wrap 300 includes one or more translucent colors. In yet another example, the wrap 300 includes a combination of colors, patterns, or symbols. The wrap 300 can be any suitable shape.

In one example, the wrap 300 can have a height corresponding to a height of a label on a prescription medication bottle. In another example, the wrap 300 can have a height greater or less than a corresponding height of a label on a prescription medication bottle. In one example, the length, or width, of the wrap 300 is equal to a circumference of a prescription medication bottle so that the wrap 300 can be applied along the entire circumference of the prescription medication bottle. In another example, the length of the wrap 300 can be longer or shorter than the circumference of a prescription medication bottle so that the wrap 300 can be applied around the prescription medication bottle less than the complete length of the circumference or more than the complete length of the circumference. For example, the wrap 300 can be applied around only half of the circumference of a prescription medication bottle, or the wrap 300 can be applied around a prescription medication bottle such that the first end 302 of the wrap 300 overlaps the second end 304 of the wrap 300.

Figure 9A:
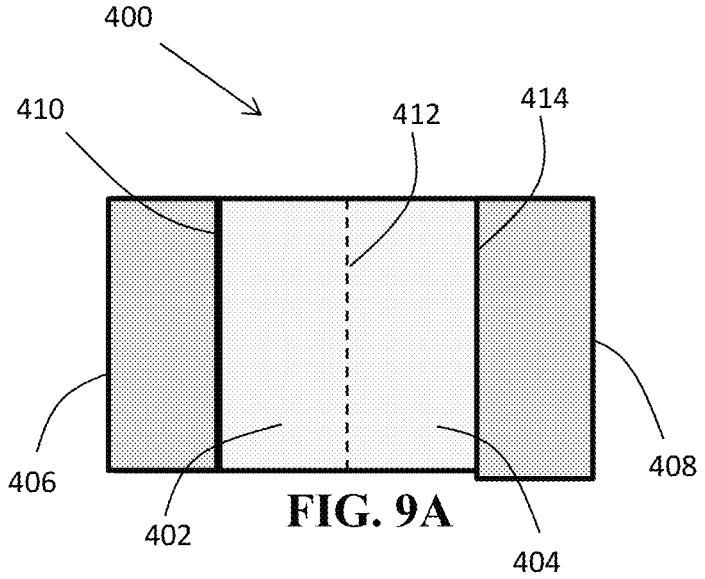
FIG. 9A is a plan view of a tab in accordance with one embodiment.
Figure 9B:
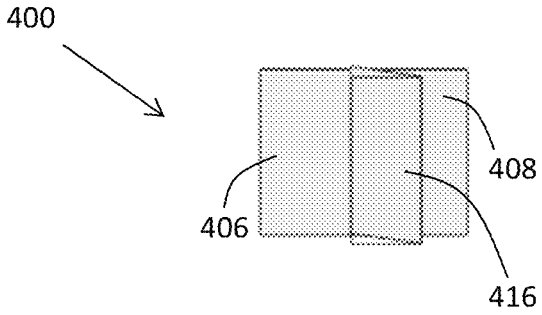
FIG. 9B is a perspective view of a tab in accordance with one embodiment.
Figure 9C:
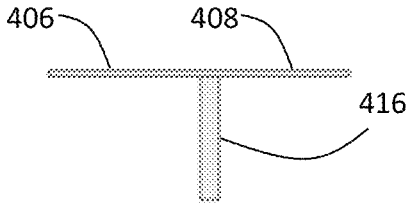
FIG. 9C is a top-side view of a tab in accordance with one embodiment.

FIG. 9A illustrates an exemplary tab 400 for application on a prescription medication bottle. Tab 400 can be arranged to include four portions—two inner portions 402, 404 and two outer portions 406, 408. Inner portions 402, 404 and outer portions 406, 408 can be folded along lines 410, 412, 414 to form the tab 400 into a butterfly-shaped arrangement. Such a butterfly shaped arrangement is illustrated in FIGS. 9B and 9C. Specifically, inner portions 402, 404 are folded along line 412 such that inner portions 402, 404 are positioned flat against one another to form a protruding portion 416 that extends away from a prescription medication bottle when the tab 400 is applied to a prescription medication bottle. Outer portions 406, 408 are folded along lines 410 and 414 respectively in order to form a base for protruding portion 416. In one embodiment, outer portions 406, 408 include an adhesive applied to back sides of the outer portions 406, 408 to secure the tab 400 to a prescription medication bottle. As described for the wrap 300 above, adhesive can be applied to the entire surface of the tab 400 that is arranged to interface with a prescription medication bottle or only a portion of surface of the tab 400 that is arranged to interface with a prescription medication bottle. Furthermore, the tab 400 can be arranged to be secured to a prescription medication bottle by static forces.

The tab 400 can be arranged to include any suitable color. In one example, the tab 400 is clear. In another example, the tab 400 is clear with a colored border. In another example, tab 400 is at least partially transparent or translucent. In another example, the tab 400 includes a combination of colors, patterns, or symbols. In one example, the tab 400 includes a paper positioned within the protruding portion 416. The paper can be white or any suitable color and arranged so that words, symbols, graphics, patterns, etc. can be printed, written or drawn on to the paper.

In one example, a wrap 300 can be initially secured to a prescription medication bottle using the adhesive on a back side of the wrap 300. Subsequently, a tab 400 can be secured to the prescription medication bottle on top of the wrap 300, using the adhesive on the back sides of the outer portions 406, 408. In another example, a tab 400 can be initially secured to a prescription medication bottle using the adhesive on the back sides of the outer portions 406, 408. Subsequently, a wrap 300 can be secured to the prescription medication bottle. In this example, the wrap 300 can be arranged such that the first and second ends 302, 304 of the wrap 300 overlap the outer portions 406, 408 of the tab 400 to further secure the tab 400 to the prescription medication bottle. In one example, only one of a wrap 300 or a tab 400 is secured to a prescription medication bottle for the purpose of applying apparatus indicative of the content of the prescription medication bottle.

In one example, a wrap 300 and a tab 400 may be provided to a patient by a pharmaceutical company or a physician in combination with a pill bottle when a medication is prescribed, sold, or given as a sample.

In one example, a wrap 300 and a tab 400 are grouped as a prescription medication bottle marking kit. The kit can include any suitable number of wraps 300 and tabs 400 in varying sizes and colors. A person can select an appropriate size and color wrap 300, tab 400, or both, to mark a prescription medication bottle based on the size of the prescription medication bottle or the contents of the prescription medication bottle. The kit can further include a writing utensil, such as a pen or marker, to add text to the wrap 300 or tab 400. It should be appreciated that a person may select a wrap 300 and a tab 400 from the kit based on other factors as well, such as the recommended dosage of the medication or the recommended frequency for consuming the medication contained in the prescription medication bottle, the days of the week medication should be taken, the health risks associated with consuming the medication contained in the prescription medication bottle, and so on.

Figure 10:
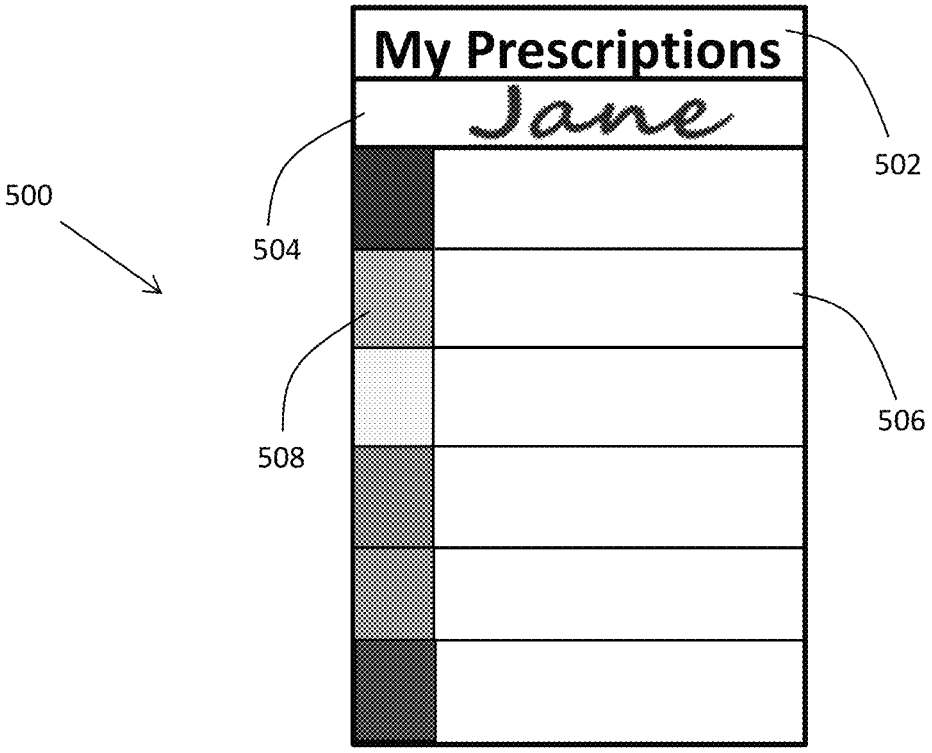
FIG. 10 is a front side view of a color coding chart in accordance with one embodiment.

In one example, a prescription medication bottle marking kit includes a color coding chart 500, as illustrated in FIG. 10. Color coding chart 500 can include a title bar 502 including text such as "my subscriptions" to describe the type of product a group of wraps and tabs are associated with. The text of the title bar 502 can be pre-filled or left blank for a person to fill in. Color coding chart 500 also includes a subtitle bar 504 to provide secondary information to further describe what person the group of wraps and tabs are associated with. For example, the subtitle bar 504 may be used to write in a person's name if a group of wraps and tabs are being used to mark a set of prescription medication bottles all associated with the same person. The subtitle bar may also be left blank for a person to fill in with suitable text or it may be pre-filled.

The color coding chart 500 can also include one or more description bars 506 associated with one more color blocks 508. Each color block 508 corresponds with a wrap or a tab to help a person organize and track markings on prescription medication bottles. Specifically, a person may write text, a symbol, or other relevant notes in description bar 506 associated with a color block 508 corresponding to a wrap or tab on a prescription medication bottle. For example, if a person marks a prescription medication bottle containing heart medication with a red wrap, the person may write a reminder in the description bar 506 associated with the red color block 508 to remind him that the red wrap or tab corresponds to heart medication. In addition, a person may write notes in the description bar that relate to last consumption time, side effects experienced, or other suitable notes relating to a medication. It should be understood that indicia blocks such as symbol blocks or pattern blocks may be used instead of color blocks.

The color coding chart 500 can be attached to a wall, a cabinet, a refrigerator, or other suitable location. Accordingly, color coding chart 500 can include, on the reverse side (not shown) an adhesive, a magnet, or other suitable means for securing the color coding chart 500 to a surface.

In one example, color coding chart 500 may be a single reusable chart such as a dry-erase board. In this example, notes or text written on the color coding chart 500 can be erased and the color coding chart may be re-used. In another example, the color coding chart 500 can include a pad of disposable paper charts. In this example, a top chart may be removed in order to expose a new chart on which new notes may be written.

Figure 11:
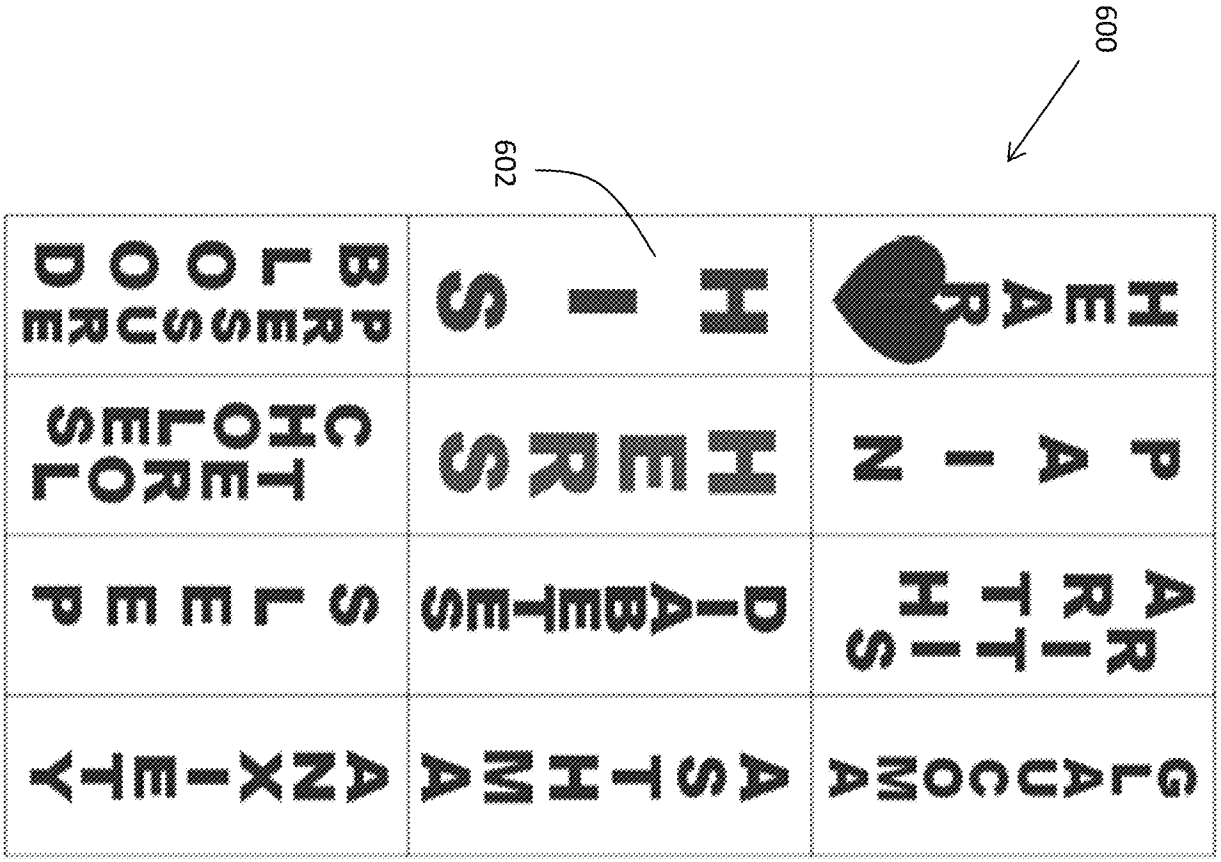
FIG. 11 is a front side view of an example peel-off-sheet in accordance with one embodiment.

In one example, a prescription medication bottle marking kit includes one or more peel-off sheets 600, as illustrated in FIG. 11. A peel-off sheet 600 can include stickers 602 including pre-printed text to mark a prescription medication bottle. The stickers can include text such as his, hers, pain, arthritis, heart, glaucoma, diabetes, asthma, blood pressure, cholesterol, sleep, and anxiety as illustrated, or other suitable text to help identify the contents of a prescription medication bottle. Stickers 602, once removed from peel-off sheet 600 may be placed on a wrap 300, on a tab 400, or anywhere on a prescription medication bottle to mark the prescription medication bottle. The peel-off sheet 600 can also include several blank stickers (not shown) that allow a person to customize the sticker.

Figure 12:
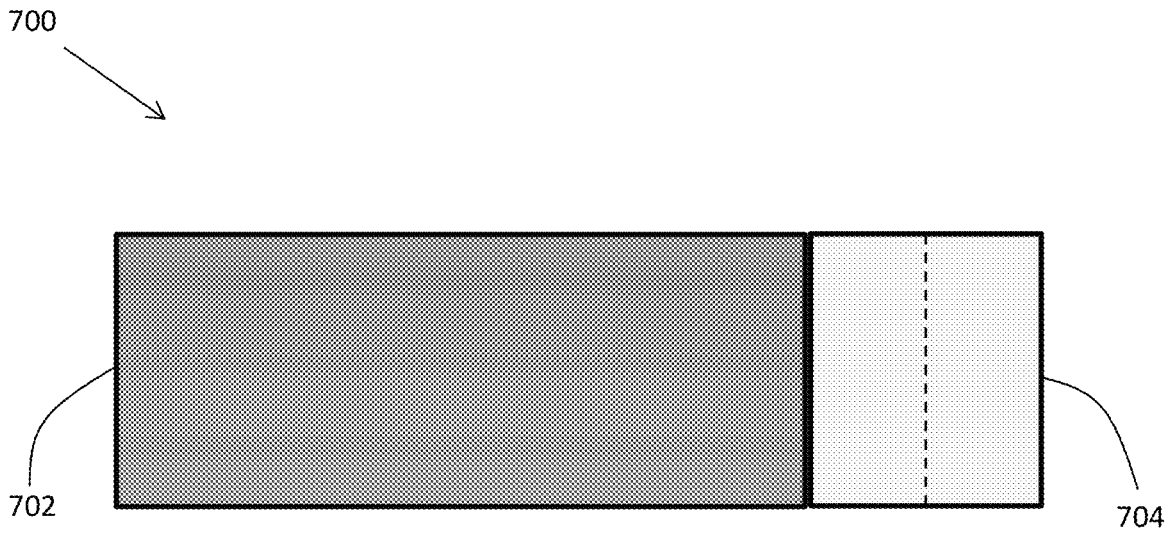
FIG. 12 is a plan view of a wrap and tab combination in accordance with one embodiment.

In one example, a prescription medication bottle marking kit includes a wrap and tab combination 700, as illustrated in FIG. 12. The wrap and tab combination 700 includes a wrap 702 with a tab 704 pre-attached to a wrap 702. The wrap and tab combination 700 may be any suitable color or combination of colors. In one example, at least one of the wrap 702 or the tab 704 is clear. In one example, at least one of the wrap 702 or the tab 704 is clear with a colored border. In one example, at least one of the wrap 702 or the tab 704 is at least partially transparent. In one example, at least one of the wrap 702 or the tab 704 includes a combination of colors, patterns, or symbols.

Figure 13:
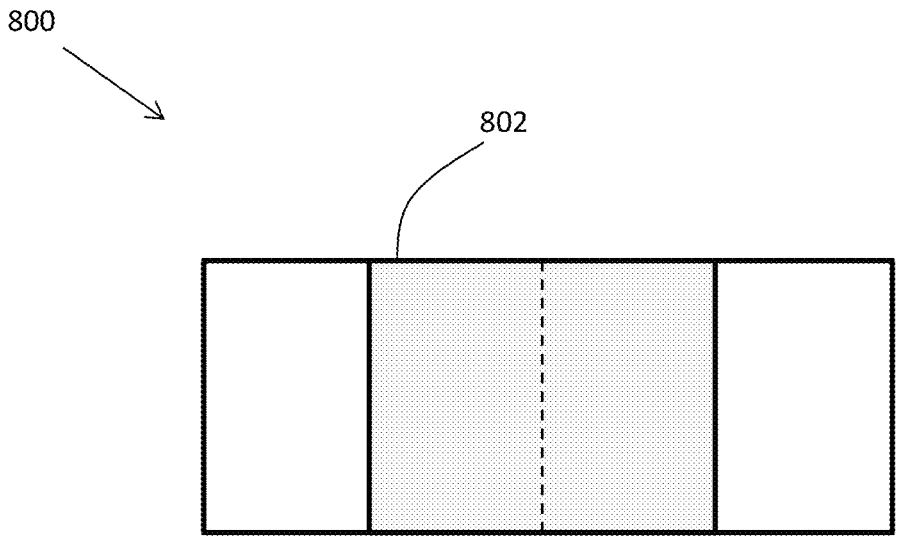
FIG. 13 is a plan view of a wrap and tab combination in accordance with one embodiment.

In one example, a wrap and tab combination 800 includes a larger tab 802 for pharmaceutical use, as illustrated in FIG. 13. The larger tab 802 allows a pharmacist to attach a pharmacy label directly onto the tab 802 instead of placing the label on a prescription medication bottle where it may cover other information.

Figure 14A:
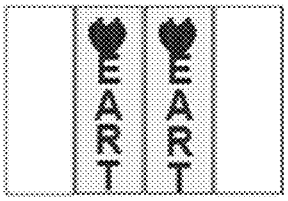
FIGS. 14A-14C are plan views of wrap and tab combinations in accordance with various embodiments.
Figure 14B:
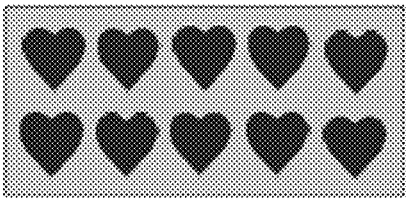
Figure 14C:
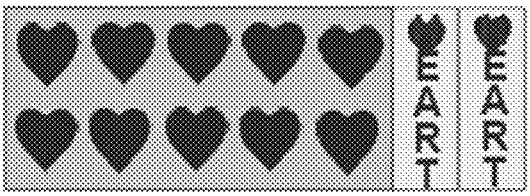

It should be understood that the wrap and tab described herein can include various suitable colors, patterns, and shapes for marking a prescription medication bottle. In three examples, as illustrated in FIGS. 14A, 14B, and 14C, a wrap and tab can include heart shaped logos for indicating that the contents of a prescription medication bottle contain heart medication. In addition, the tab may include the text "heart" and the wrap can be red in color to further indicate that the prescription medication bottle contains heart medication.

Figure 15:
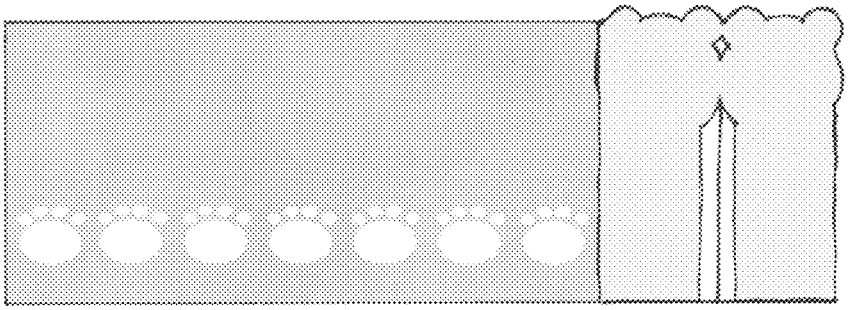
FIG. 15 is a plan view of wrap and tab combinations in accordance with one embodiment.

In one example, as illustrated in FIG. 15, a wrap and tab can be used to mark a prescription medication bottle as containing medications intended for an animal such as a pet dog or cat, or other pet. Specifically, the wrap can include symbols indicative of a specific animal such as dog paws and the tab can include symbols or cutouts of a face or profile of a pet. It should be appreciated that other suitable text, symbols, and combinations of colors can be used on a wrap and tab to indicate that the contents of a prescription medication bottle are intended for a pet.

Figure 16:
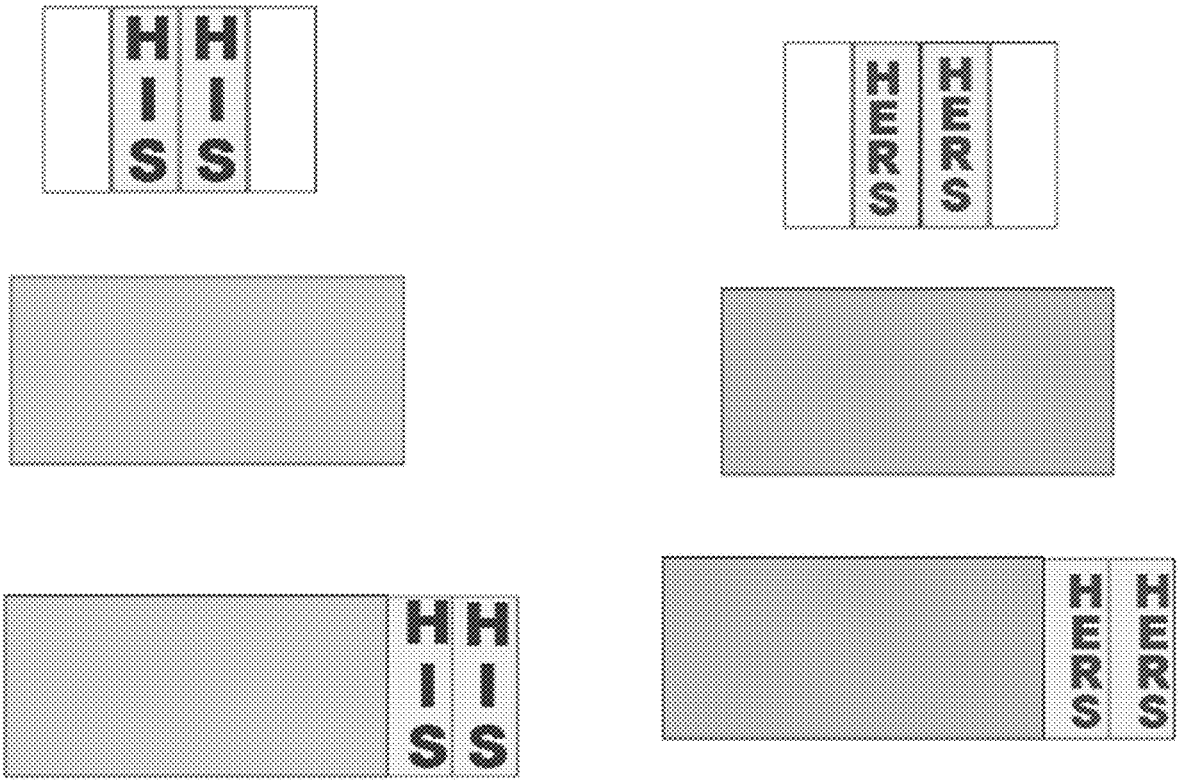
FIG. 16 are plan views of tabs, wraps, and wrap and tab combinations in accordance with various embodiments.

In one example, as illustrated in FIG. 16, wraps and tabs can include text such as "his" and "hers" and be colored either red or blue to help differentiate a prescription medication bottle belonging to a male from a prescription medication bottle belonging to a female. It will be appreciated that other suitable text, symbols, and combinations of colors can be used on a wrap and tab to differentiate a prescription medication bottle belonging to a male from a prescription medication bottle belonging to a female. In another example (not shown), wraps and tabs can include text or colors to help differentiate between prescription medication bottles belonging to multiple family members.

Figure 17:
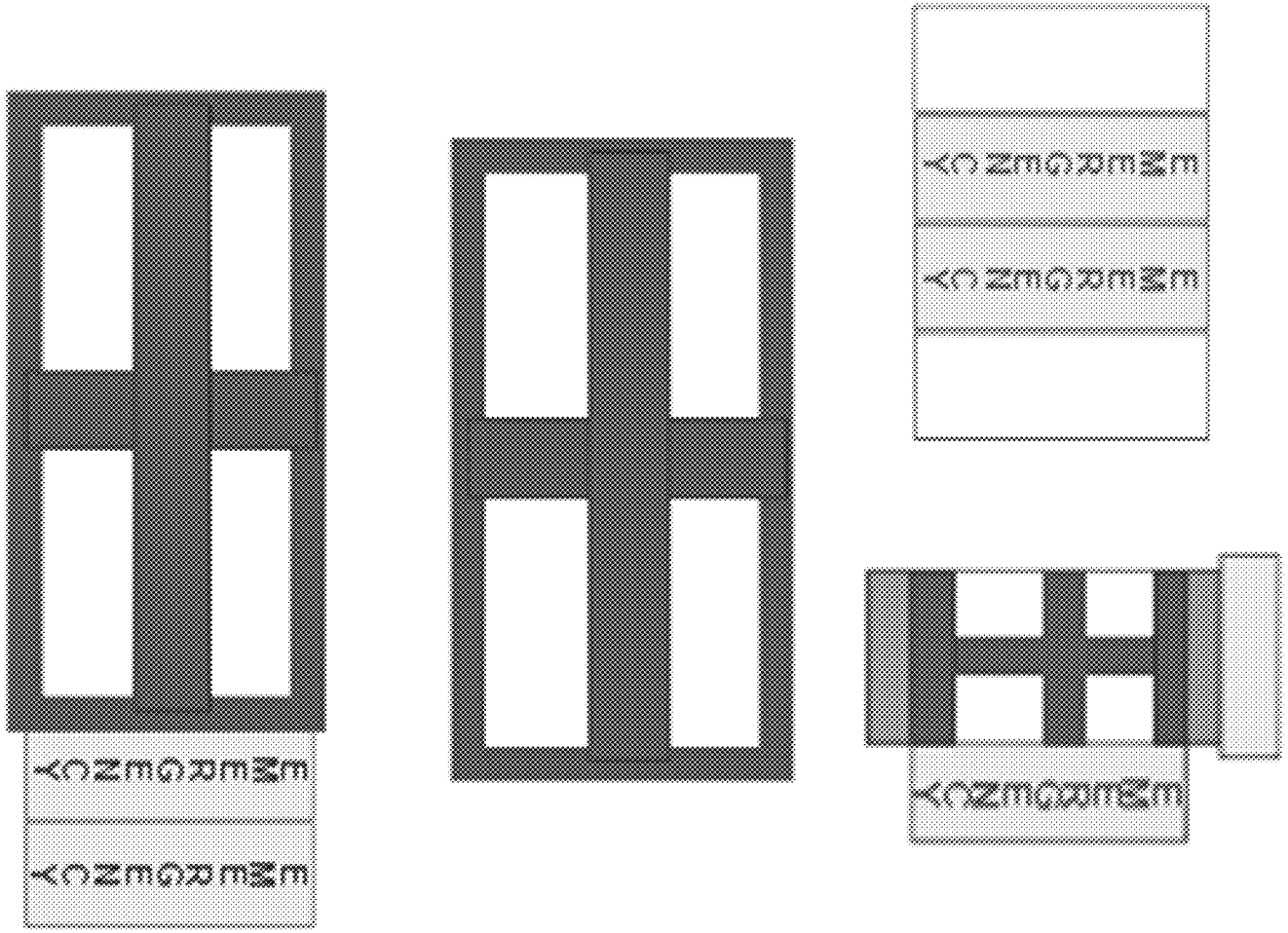
FIG. 17 are plan views of wrap and tab combinations in accordance with various embodiments.

In one example, as illustrated in FIG. 17, a tab can include the text "emergency" while a wrap can include a red cross symbol to indicate that the contents of a prescription medication bottle are emergency medication. It will be appreciated that other suitable text, symbols, and combinations of colors can be used on a wrap and tab to indicate that the contents of a prescription medication bottle are emergency medication.

Figure 18:
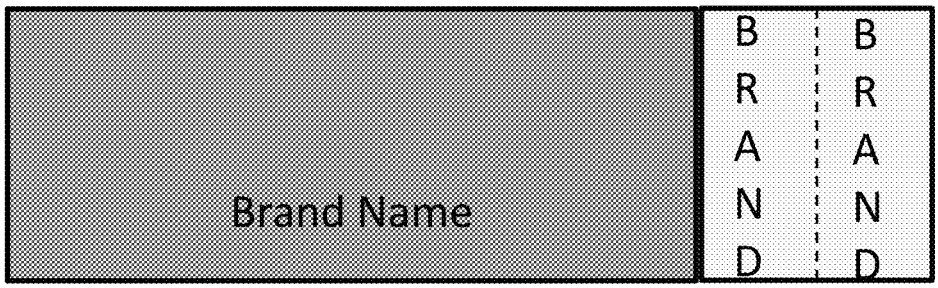
FIG. 18 is a plan view of wrap and tab combinations in accordance with one embodiment.

In one example, as illustrated in FIG. 18, a wrap and tab can include text, symbols, or graphics, associated with a brand name or trademark.

It will be appreciated that, although the examples described herein reference the use of exemplary wraps and/or tabs in connection with marking prescription medication bottles, the exemplary wraps and/or tabs and other similar wraps and/or tabs can be used to mark any suitable container or item to assist observers in more easily recognizing and distinguishing a given item from other similar items.

In one example, suitable wraps and/or tabs can be used to distinguish beverage containers such as bottles, glasses and cups. A system of wraps and/or tabs can be used to distinguish beverage containers at a social gathering such as a wedding or party so that an individual guest or attendee can identify his or her beverage container from among the beverage containers of other guests or attendees. In one example, a wrap and/or a tab can be placed on the neck of a glass beverage bottle. Colors, patterns, written text, or other such indicia can be used to distinguish between the glass beverage bottles. Similarly, a glass, such as wine glasses or coffee cups, or a plastic beverage cup can be adorned with a wrap and/or tab that includes indicia that can be useful in distinguishing between glasses or cups. The wraps and tabs can be arranged such that any adhesive on the wrap or tabs does not mar or damage the item.

In another example, wraps and/or tabs can be arranged with messages specific to an event or gathering. For instance, a wrap and/or tab can be arranged for use during a ceremonial toast at a wedding. A tab can be attached to the stem of champagne glasses used for the ceremonial toast and include messages such as "congratulations," "best wishes," include the names of the groom and bride, and so on. Similarly, for a birthday party, plastic cups could be adorned with wraps with messages such as "happy birthday," the name of the person celebrating a birthday, and so on.

In another example, wraps and tabs can be arranged to label food containers for any number of purposes. If a person has a specific dietary preference or food allergy (i.e., vegetarian, vegan, nut allergies, calcium intolerance, glutton sensitivity, etc.) understanding the content of food containers can be critical in maintaining an appropriate and healthy diet. This can be particularly so when a number of people share living arrangements such as families, roommates, etc. Wraps and tabs can be applied to various food containers with indicia to indicate which dietary restrictions are satisfied by the contents of the food container. Such a system can alleviate the need to reread labels on purchased food products that remain in original containers, or can properly identify food stored in temporary containers such as Tupperware or zip-lock bags. Furthermore, wraps or tabs can be used to date food items so that users can readily ascertain whether a specific beverage such as milk or food such as eggs are past the recommended "consume by" date.

Figure 19A:
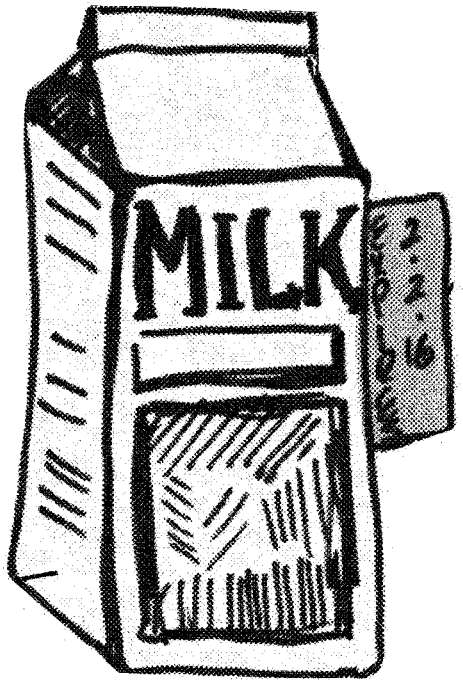
FIGS. 19A-19C are perspective views of tabs in accordance with various embodiments.
Figure 19B:
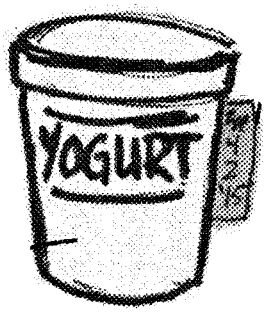
Figure 19C:
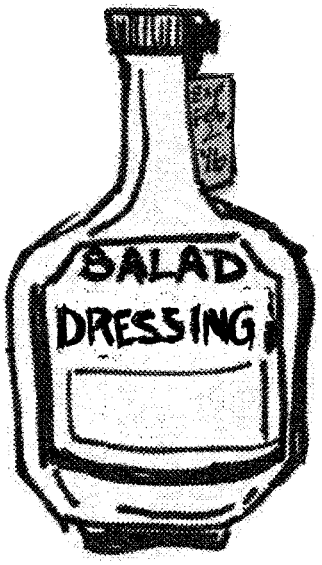

FIGS. 19A-19C illustrate embodiments of tabs arranged with food containers. In one example, a milk carton 902 includes a tab 904 with an expiration date written on the tab 904. The expiration date can be written so that it is prominently displayed and can be quickly and readily viewed. Such prominent placement of the tab 904 with the expiration date alleviates the need for consumers of the milk to search the milk carton 902 for an expiration date. FIGS. 19B and 19C similarly display a yogurt container 906 and a tab 908 and a salad bottle 910 and a tab 912. It will be understood that the tabs 904, 908, 912 can include any number of indicia that relays information to a consumer. For example, the labels can include terms or phrases useful to the consumer such as "vegetarian," "vegan," "contains nuts," "contains dairy," "contains gluten," "contains soy," "high salt content," a person's (i.e., owner's) name, and so on.

In living situations where two or more roommates use the same refrigerator, pantry, and/or cupboards, wraps and/or tabs can be used to simply identify what food or other items belong to which roommate. Similarly, wraps and/or tabs can be used to distinguish personal care items for family members or roommates. For example, cosmetics, shampoo, conditioner, etc. can be distinguished by applying wraps or tabs with unique indicia.

It will be readily understood that in addition to items such as medications, food and beverages, all manners of other items can be identified and distinguished by wraps and/or tabs. For example, music CD's or movie DVD's can be labeled with wraps or tabs. Colors or other indicia can be indicative of artist, genre, or any other attribute of CD or DVD content. In another example, wraps and/or tabs can be used to identify school supplies such as pencils, notebooks, rulers, etc. in a classroom environment. Using such a system can allow even young students to readily identify his or her pen or pencil from that of classmates. In yet another example, wraps and/or tabs can be used to label cords and cables such as those used for computer equipment or audio/video equipment.

Figure 20:
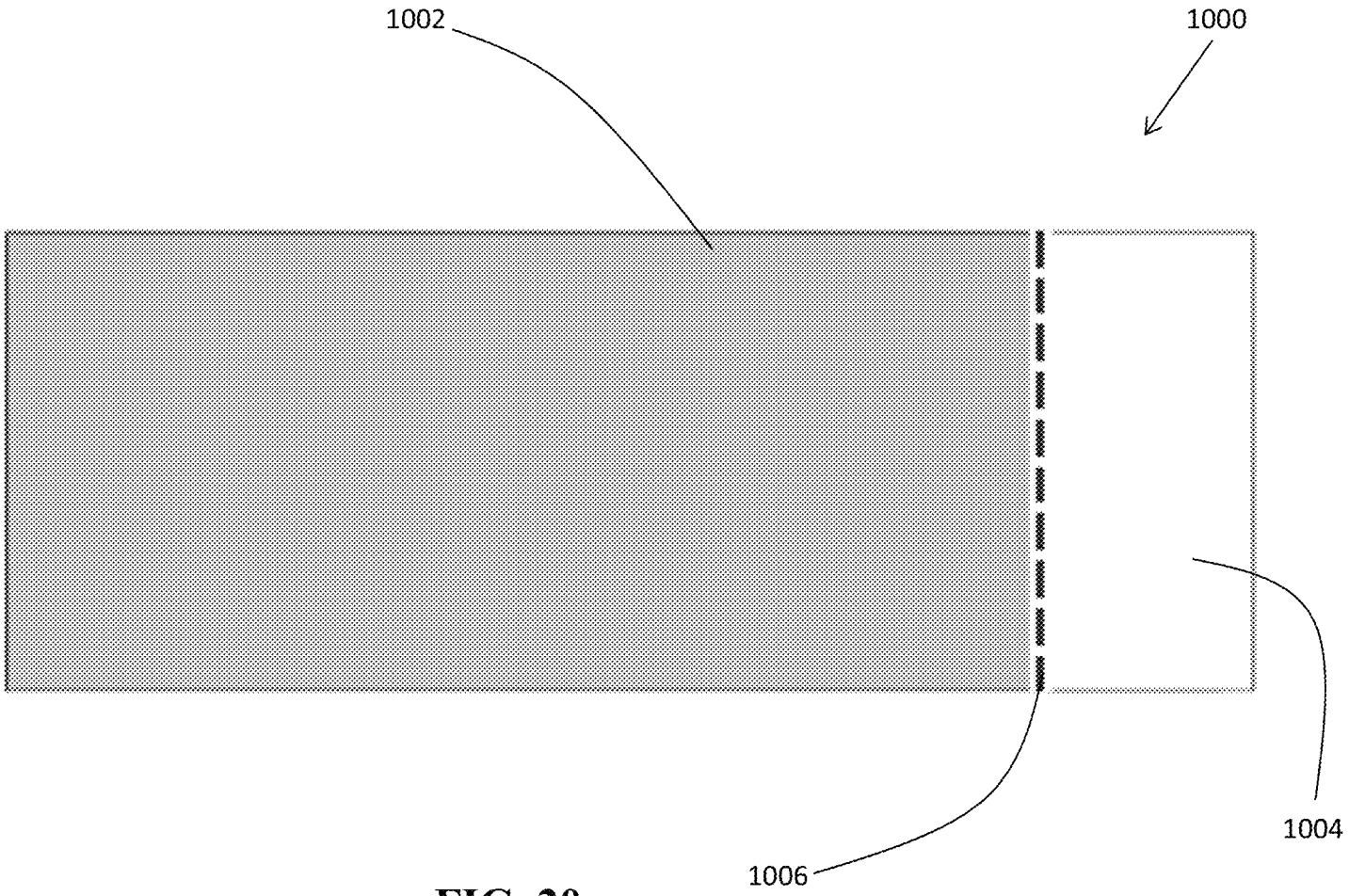
FIG. 20 is a plan view wrap and tab combination wherein the interface between the wrap and the tab includes a perforation.
Figure 21:
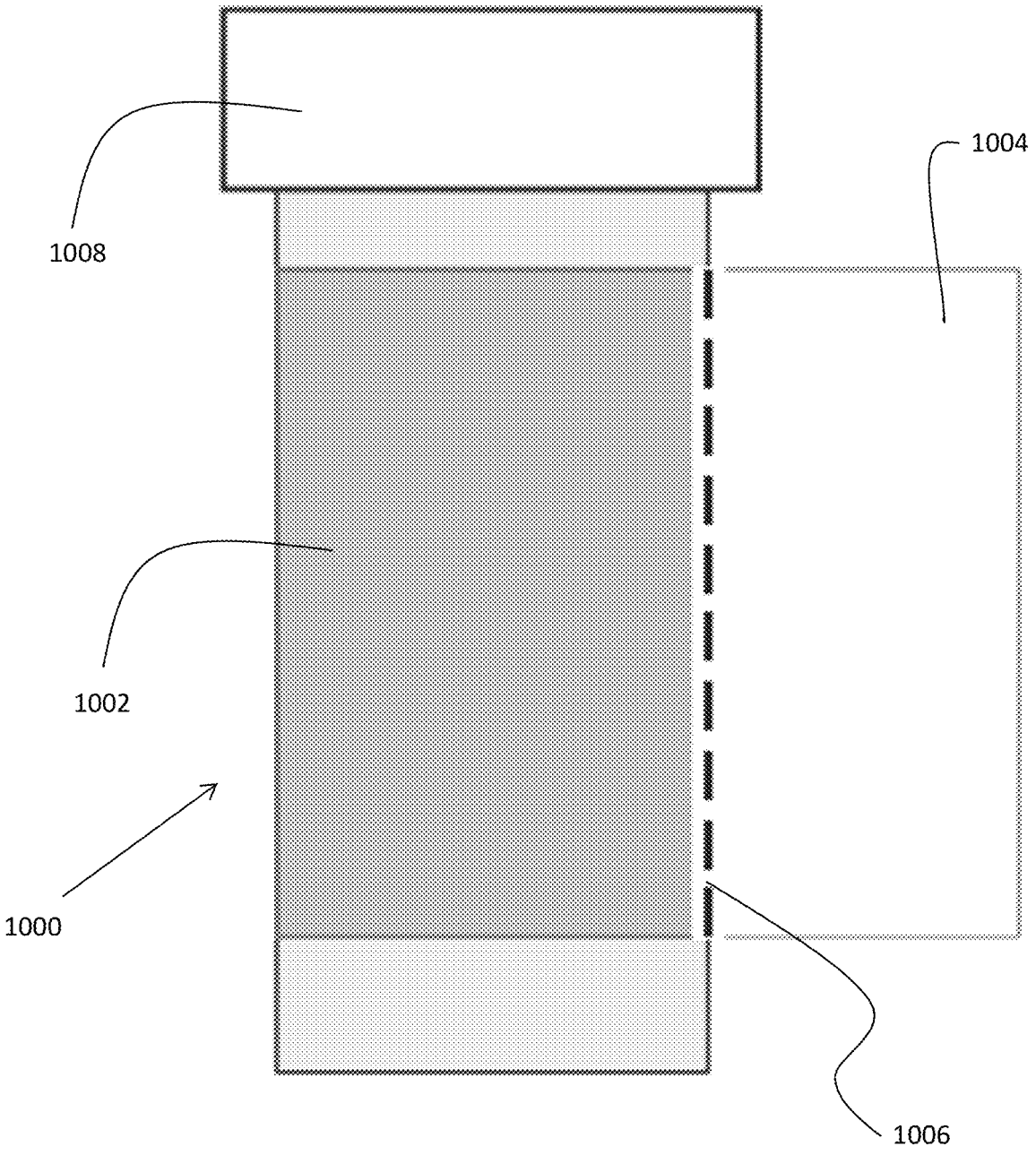
FIG. 21 is a perspective view of the wrap and tab combination of FIG. 20 applied to a medication bottle.
Figure 22:
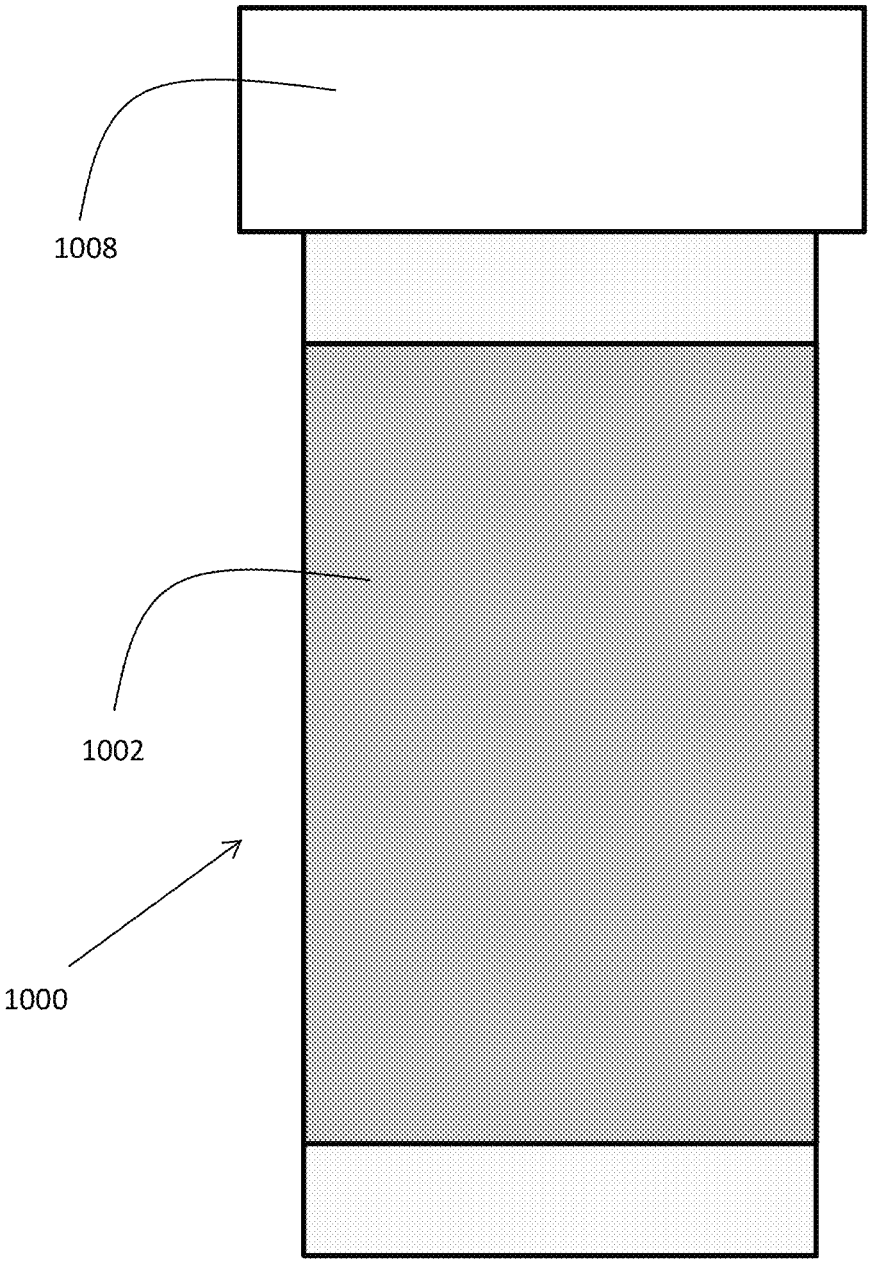
FIG. 22 is a perspective view of the wrap and tab combination of FIG. 20 applied to a medication bottle with the tab removed at the perforated interface.

FIGS. 20-22 illustrate another embodiment of a prescription medication bottle marking kit that includes a wrap and tab combination 1000. The wrap and tab combination 1000 includes a wrap 1002 with a tab 1004 pre-attached to a wrap 1002. The wrap and tab combination 1000 may be any suitable color or combination of colors. In one example, at least one of the wrap 1002 or the tab 1004 is clear. In one example, at least one of the wrap 1002 or the tab 1004 is clear with a colored border. In one example, at least one of the wrap 1002 or the tab 1004 is at least partially transparent. In one example, at least one of the wrap 1002 or the tab 1004 includes a combination of colors, patterns, or symbols.

In the embodiment illustrated in FIGS. 20-22, the interface between the wrap 1002 and tab 1004 includes a perforation 1006. As best illustrated in FIG. 20, the perforation 1006 extends from a one edge of the wrap and tab combination 1000 to the other edge of the wrap and tab combination 1000, and makes up the entire interface between the wrap 1002 and tab 1004. As will be understood, the perforation is arranged in a straight line and comprises a series of spaced apart slots between sections of material that connect the tab 1004 to the wrap 1002. Such an arrangement makes is easier for a user to selectively detach the tab 1004 from the wrap 1002.

In such an arrangement, the user has the choice between using the wrap and tab combination 1000 as a single unit or only using the wrap 1002 or the tab 1004. For example, as illustrated in FIG. 21, the wrap and tab combination 1000 can be secured to a prescription medication bottle 1008, where the wrap 1002 is attached to the body of the prescription medication bottle 1008 and the tab 1004 extends away for the prescription medication bottle 1008. Alternatively, as illustrated in FIG. 22, the wrap 1002 alone can be secured to a prescription medication bottle 1008, where the wrap 1002 is attached to the body of the prescription medication bottle 1008. The user can achieve such a result by removing the tab 1004 from the wrap 1002 prior to application of the wrap 1002 to the prescription medication bottle 1008. The user can remove the tab 1004 from the wrap 1002 by securing the wrap 1002 in one hand and securing the tab 1004 in the other hand and tearing along the perforation 1006 until the tab 1004 is separated from the wrap 1002. The tab 1004 can then be discarded if not needed or repurposed for labeling or other functions. The user can also use the wrap and tab combination 1000 initially together and subsequently separate the tab 1004 from the wrap 1002. For example, the user can secure the wrap and tab combination 1000 to the prescription medication bottle 1008 in the arrangement illustrated in FIG. 21. Then, when later desired, the user can separate the tab 1004 from the wrap 1002 in a manner similar to the description above. The user can use one hand to hold the wrap 1002 firmly to the prescription medication bottle 1006, grasp the tab 1004 with the other hand, and tearing along the perforation 1006 until the tab 1004 is separated from the wrap 1002. The end result will be the arrangement illustrated in FIG. 22.

The wrap 1002 can include an adhesive on a surface of the wrap 1002 that is arranged to interface with the prescription medication bottle 1008. The adhesive can facilitate the wrap 1002 adhering to the prescription medication bottle 1008. The wrap 1002 can include any suitable adhesive such as glue, tape, and the like. The adhesive can be applied to the wrap 1002 to sufficiently secure the wrap 1002 to the prescription medication bottle 1008. In one embodiment, adhesive is applied to the entire surface of the wrap 1002 arranged to interface with the prescription medication bottle 1008. In another embodiment, adhesive is applied to a portion of the surface of the wrap 1002 arranged to interface with the prescription medication bottle 1008. For example, adhesive can be applied to only a first end and a second end of the wrap 1002. In another example, adhesive can be applied along the perimeter of the surface of the wrap 1002 arranged to interface with the prescription medication bottle 1008. In yet another example, adhesive can be applied in a pattern to the surface of the wrap 1002 arranged to interface with the prescription medication bottle 1008.

The adhesive can be applied to the wrap 1002 so that the wrap 1002 is reversibly secured to the prescription medical bottle 1008. This is to say that the wrap 1002 can be first applied to a prescription medication bottle 1008 and then at a later time removed from the prescription medication bottle 1008 such that the wrap 1002 remains intact. In such an embodiment, the wrap 1002 can be arranged to be reusable after the wrap 1002 has been applied to and removed from a prescription medication bottle 1008. In yet another example, the wrap 1002 can be arranged such that the wrap 1002 is secured to a prescription medication bottle 1008 by static forces.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Additionally, to the extent that the terms "on" or "onto" are used in the specification or the claims, it is intended to additionally mean "in," "into," or "near." Furthermore, to the extent the term "connect" is used in the specification or claims, it is intended to mean not only "directly connected to," but also "indirectly connected to" such as connected through another component or components.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

What is claimed is:

1. A marked container system comprising:

a container having information on its outside surface, the information pertaining to the container and/or its contents;

a wrap applied to the outside surface of the container, the wrap having:

a first portion comprising an area that is at least partially transparent configured to show at least a portion of the information of the container and/or its contents, a tab adjacent to the first portion that comprises at least one indicium identifying the container and/or its contents and protrudes away from the container, wherein the tab comprises:

two outer portions configured to fold and form a base comprising an adhesive back for adhering to the container; and two inner portions configured to fold and form the tab, protruding away from the container when the wrap is applied to the outside surface of the container; and an adhesive layer between a first side of the first portion of the wrap and the container, that attaches the wrap to the container.

2. The system of claim 1, wherein the at least one indicium comprises at least one of a color, a symbol, a pattern, and text.

3. The system of claim 1, further comprising an indicia coding chart comprising at least one description bar that includes an indicium matching one of the at least one indicium of at least one of the first portion or the tab.

4. The system of claim 1, further comprising a peel off sheet comprising at least one sticker that includes an indicium matching one of the at least one indicium of at least one of the first portion or the tab.

5. The system of claim 1, wherein the at least one indicium for identifying the container or the contents of the container is associated with a prescription medication.

6. The system of claim 1, wherein the wrap is configured to removably attach to the container.

7. The system of claim 1, wherein a perforation is disposed between the tab and the first portion of the wrap, and the tab is configured to be separated from the first portion of the wrap by tearing the wrap at the perforation.

8. A marked container system comprising:

a container having information on its outside surface, the information pertaining to the container and/or its contents;

a wrap applied to the outside surface of the container, the wrap having:

an adhesive layer between a first side of the wrap and the container that attaches the wrap to the outside surface of the container, and an area that is at least partially transparent and configured to show at least a portion of the information of the container and/or its contents, and a tab separate from the wrap, the tab configured to adhere to the outside surface of the container and protrude away from the container, the tab comprising an indicium of the container and/or its contents.

9. The system of claim 8, further comprising at least a second indicium on the tab for identifying at least one of the container or its contents, the indicium comprising at least one of a color, a symbol, a pattern, and text.

10. The system of claim 9, further comprising an indicia coding chart comprising at least one description bar that describes an indicium corresponding to an indicium of the tab.

11. The system of claim 9, further comprising a peel off sheet comprising at least one sticker that includes an indicium corresponding to an indicium of the tab.

12. The system of claim 9, wherein the indicium of the tab is associated with a prescription medication disposed in the container.

13. The system of claim 8, wherein the tab comprises:

two outer portions configured to fold and form a base comprising an adhesive back for adhering to the container; and two inner portions configured to fold and form a protruding portion for extending away from the container.

* * * * *